US005594971A

United States Patent [19]

Nelson

[11] Patent Number: 5,594,971

[45] Date of Patent: Jan. 21, 1997

[54] PAINT ROLLER FRAME ASSEMBLY WITH LOCK EQUIPPED END MEMBER

[76] Inventor: James A. Nelson, 415 Highway 101 South, Crescent City, Calif. 59931

[21] Appl. No.: 511,106

[22] Filed: Aug. 4, 1995

[51] Int. Cl.[6] ..... B05C 17/02

[52] U.S. Cl. ..... 15/230.11; 15/230.14

[58] Field of Search ..... 15/230.11, 230.14, 15/230.19, DIG. 10; D4/122; 401/197, 208

[56] References Cited

U.S. PATENT DOCUMENTS

| | | | |
|---|---|---|---|
| D. 341,256 | 11/1993 | Brazis et al. | D4/122 |
| 3,119,137 | 1/1964 | Schueler | 15/230.11 |
| 3,201,815 | 8/1965 | Selby . | |
| 3,225,373 | 12/1965 | Kisbany | 15/230.11 |
| 4,316,301 | 2/1982 | Smith et al. . | |
| 4,361,923 | 12/1982 | McKay | 15/230.11 |
| 4,422,201 | 12/1983 | McKay . | |
| 4,717,276 | 1/1988 | O'Brien et al. | 15/230.11 |

FOREIGN PATENT DOCUMENTS

| | | | |
|---|---|---|---|
| 0619159 | 3/1961 | Canada | 15/230.11 |
| 0922693 | 1/1955 | Germany | 15/230.11 |

*Primary Examiner*—David Scherbel
*Assistant Examiner*—James F. Hook
*Attorney, Agent, or Firm*—James D. Givnan, Jr.

[57] ABSTRACT

A paint roller assembly includes a wire frame having a spindle on which a wire cage is rotatably mounted with end mounted bearing members. An outermost bearing member includes an annular wall provided with a flexible arm having a stop at its distal end. The stop normally abuts an end of a tubular paint roller to lock same against lengthwise movement. A paint barrier on the bearing member defines an area for momentary reception of the arm and stop during roller removal and installation procedures.

2 Claims, 1 Drawing Sheet

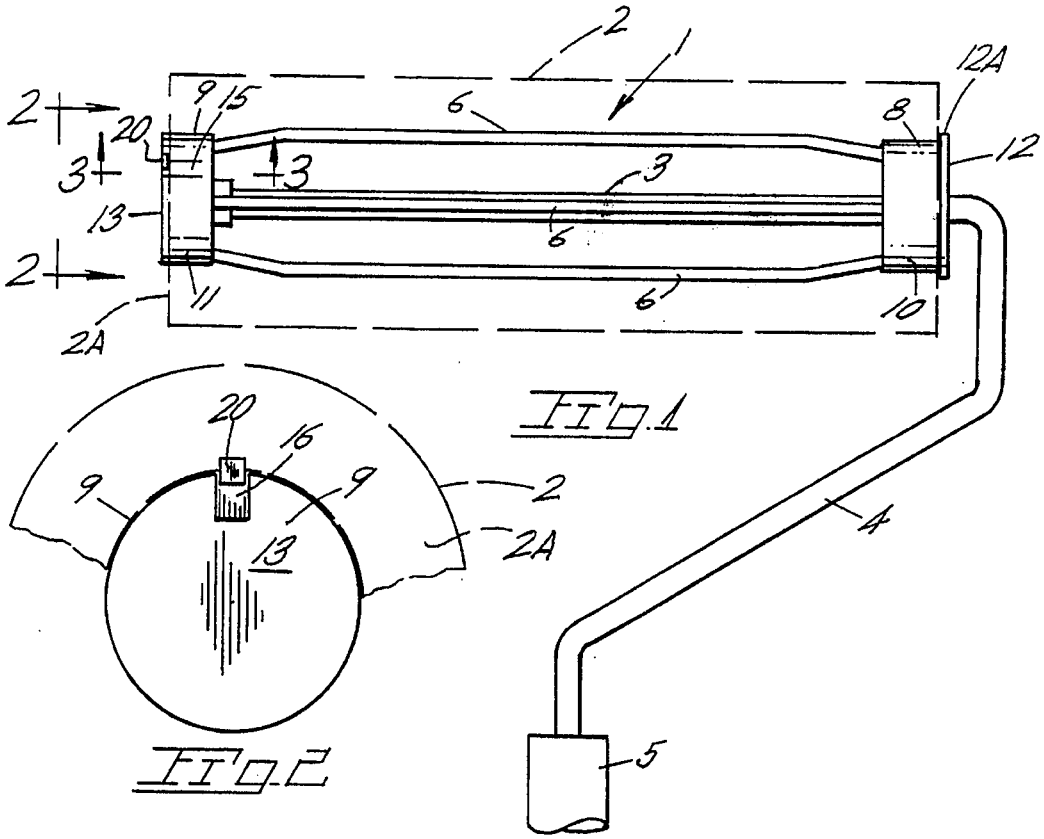
FIG. 1
FIG. 2
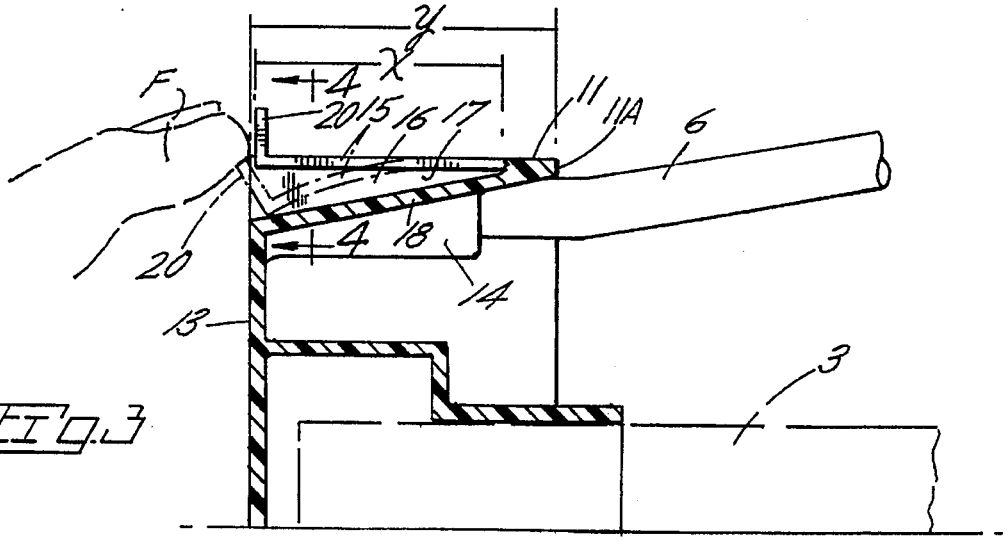
FIG. 3
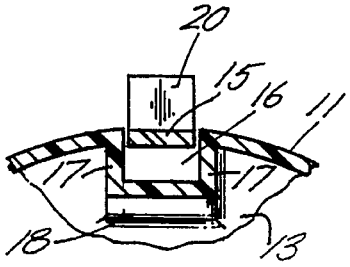
FIG. 4

PAINT ROLLER FRAME ASSEMBLY WITH LOCK EQUIPPED END MEMBER

BACKGROUND OF THE INVENTION

The present invention concerns a paint roller assembly of the type having a frame on which a tubular, paint carrying roller, is carried.

In common use are roller frame assemblies on which paint laden rollers are rotatably carried for the painting of wall surfaces. The rollers are of a sleeve or tubular configuration for lengthwise installation on rotatable structure of the assembly. Paint rollers may rely on frictional engagement with a wire cage structure for retention. The wire members terminate in securement within sockets formed in circular end caps spaced along a spindle of the roller frame assembly.

Such roller frame assemblies are subject to failing to provide adequate frictional engagement with the inner wall of a paint roller with the result being gradual lengthwise displacement of the roller during use which necessitates stopping of a painting effort and repositioning of the roller back into place on the wire cage or other rotatable support. Such efforts contribute to an untidy painting operation and adds to the painting task at hand. A contributory factor is the failure of paint rollers to be a precise uniform inner diameter for snug engagement with the wire cap or other supporting structure. Long use of a roller can also cause loss of a snug fit with the roller frame assembly.

U.S. Pat. No. 4,316,301 discloses removable end cap structure at 22 and 122 which is complex design and assembly with closures 32 and 132. An inner end cap at 120 has an annular array of ridges 144 each on a wall segment 140*a* to accept a roll end tool wherein a sleeve supporting cylinder 32 terminates in an annular row of resilient fingers 40 in place entirely about the cylinder end. U.S. Pat. No. 4,361,923 shows a lint removing tool having an end cap 48 with a continuous series of flexible fingers. U.S. Pat. No. 3,201,815 shows a lint removal tool wherein a pair of flexible arms are each provided with a flange for retention of a tubular core of a tape roll.

SUMMARY OF THE PRESENT INVENTION

The present invention is embodied in bearing member of a roller frame assembly of the type receiving a tubular paint roller.

The bearing member includes an annular wall about which one end of a paint roller is supported. The present bearing member carries a lock which normally confines the roller against outward movement relative a spindle of the roller frame assembly. The lock is integral with the annular wall of the bearing member and includes an arm which may be radially displaced to momentarily displace a stop on the arm away from the roller end to permit extraction of the roller for replacement purposes. Similarly, the arm may be displaced by fingertip exerted pressure to position the stop radially inward to permit passage of the advancing end of a replacement roller. The bearing member also constitutes a barrier to preventing the entry of paint into the interior of the roller.

Important objectives of the present invention include the provision of a positive, manually operated lock to confine a paint roller against undesired longitudinal movement when in use on a roller frame assembly; the provision of an outer bearing member of a roller frame assembly with a lock including a flexible arm having a radially directed stop normally disposed in abutment with an end of a paint roller and is displaceable by fingertip pressure for purposes of roller removal and replacement; the provision of a bearing member on a roller frame which includes a stop positionable by fingertip pressure to confine a paint roller against lengthwise movement yet permitting rapid roller removal and installation of a replacement roller without the use of a tool.

BRIEF DESCRIPTION OF THE DRAWINGS

In the accompanying drawings:

FIG. 1 is an elevational view of a roller frame assembly with a paint roller thereon shown in phantom lines;

FIG. 2 is an end view of FIG. 1 taken along line 2—2 thereof;

FIG. 3 is a sectional view taken along line 3—3 of FIG. 1;

FIG. 4 is a vertical sectional view taken along lines 4—4 of FIG. 3.

DETAILED DESCRIPTION OF THE PREFERRED EMBODIMENTS

With continuing reference to the drawings, the reference numeral 1 indicates generally rotatable structure for the reception of a roller 2 for rotatably mounting the roller on a spindle 3. Spindle 3 is an extension of a bent wire frame 4 which terminates in a handle 5. The rotatable structure above noted may include what is referred to in the trade as a wire cage for those roller frame assemblies utilizing multiple wires as at 6 on which tubular roller 2 is slidably mounted. The wire ends are received in later described sockets disposed interiorly about inner and outer bearing members 8 and 9 each having an annular wall 10 and 11. Additionally the bearing members include opposite facing outer end walls at 12 and 13. End wall 12 has a rim 12A.

The foregoing is intended to be a description of a typical roller frame assembly. However, it is to be understood that such an assembly may dispense with the wire members and rely solely on bearing members 8–9 for support of a tubular roller. Sockets 14 receive ends of wire 6.

With further attention to outer bearing member 9, the same is modified to include the present invention and provides a lock to retain roller 2 against axial displacement during painting. An arm 15 is integral at its proximal end with a bearing member annular side wall 11. A channel 16 in the bearing member is defined by sidewalls 17 (FIG. 4) and an interconnecting wall 18. Such a wall arrangement is of U-shape in transverse section to define area 16 which receives arm 15 during momentary displacement by a fingertip F. The walls 17–18 provide a barrier which prevents the flow of paint into the interior of the bearing member. Arm 15 is of a length indicated at X which constitutes a major portion of the axial dimension indicated at Y of the bearing member. Arm 15 terminates inwardly adjacent an inner edge 11A of annular wall 11.

With attention again to arm 15, the same terminates at its distal end in a stop 20 which projects radially outward relative bearing member wall 11 to prevent passage of a roller outer end 2A past the bearing member. The bearing member is formed from a suitable plastic to enable arm 15 to be of a flexible nature, allowing arm and stop displacement by the application of fingertip exerted force, as shown in FIG. 3. Accordingly, removal of roller 2 may be achieved by momentary fingertip displacement of stop 20 to permit the advancement of roller end 2A slightly therepast, whereafter the stop slides along the inner wall of the roller. Conversely, for installation of a new roller, fingertip pressure is applied directly to arm 15 to displace the arm and specifically stop 20 into channel 16, whereupon the inner end of the roller may be slid over the stop which remains retracted in channel 16 by the roller until passage of outer end 2A of the roller therepast.

Regardless of variances in the inner diameter between rollers, occuring during manufacture or from use, roller 2 will be confined against outward displacement as stop 20 will be abutted by the roller core. The outer cap barrier provided by walls 17, 18 will at all times prevent entry of paint into the roller interior while lending itself to convenient cleaning at the end of a painting operation.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. In a paint roller assembly having a spindle and inner and outer bearing members on said spindle for lengthwise reception of a tubular paint roller, said outer bearing member having an outer end wall and an annular side wall terminating at an inner edge, the improvement comprising a flexible arm having a proximal end integral with said side wall adjacent said inner edge and having a distal end adjacent said outer end wall including a stop normally disposed in a radially projecting position relative said annular side wall to confine a tubular roller against lengthwise movement, said flexible arm permitting radial displacement of the stop away from the roller to permit roller passage past said stop, a paint barrier proximate said arm and including sidewalls and an interconnecting wall both integral with said end wall and said annular side wall, said barrier defining a channel to receive said flexible arm when displaced radially inward of the annular side wall during positioning of the paint roller.

2. The invention claimed in claim 1 wherein said paint barrier is of U-shape in transverse cross section.

* * * * *